US008875901B2

(12) United States Patent
Wellwood et al.

(10) Patent No.: US 8,875,901 B2
(45) Date of Patent: Nov. 4, 2014

(54) SORTING MINED MATERIAL ON THE BASIS OF TWO OR MORE PROPERTIES OF THE MATERIAL

(75) Inventors: Grant Ashley Wellwood, Phesant Creek (AU); Christopher Geoffrey Goodes, Eltham (AU)

(73) Assignee: Technological Resources Pty. Ltd., Melbourne, Victoria (AU)

( * ) Notice: Subject to any disclaimer, the term of this patent is extended or adjusted under 35 U.S.C. 154(b) by 0 days.

(21) Appl. No.: 13/636,011

(22) PCT Filed: Mar. 23, 2011

(86) PCT No.: PCT/AU2011/000325

§ 371 (c)(1),
(2), (4) Date: Dec. 4, 2012

(87) PCT Pub. No.: WO2011/116417

PCT Pub. Date: Sep. 29, 2011

(65) Prior Publication Data

US 2013/0073077 A1 Mar. 21, 2013

(30) Foreign Application Priority Data

Mar. 23, 2010 (AU) ..... 2010901239

(51) Int. Cl.

| | |
|---|---|
| ***B07C 5/00*** | (2006.01) |
| ***B07C 5/34*** | (2006.01) |
| ***B07C 5/36*** | (2006.01) |

(52) U.S. Cl.

CPC .. *B07C 5/34* (2013.01); *B07C 5/368* (2013.01)
USPC ..... 209/552; 209/577; 209/589; 209/599

(58) Field of Classification Search

USPC ..... 209/552, 576, 589, 599
See application file for complete search history.

(56) References Cited

U.S. PATENT DOCUMENTS 4,713,798 A * 12/1987 Kay ..... 367/96
4,884,696 A * 12/1989 Peleg ..... 209/545

(Continued)

FOREIGN PATENT DOCUMENTS

DE 43 43 058 A1 6/1995
GB 1346566 2/1974

(Continued)

OTHER PUBLICATIONS

International Search Report issued by the Australian Patent Office in International Application No. PCT/AU2011/000325, mailed May 17, 2011 (3 pages).

(Continued)

*Primary Examiner* — Terrell Matthews
(74) *Attorney, Agent, or Firm* — Banner & Witcoff, Ltd.

(57) ABSTRACT

A method and an apparatus for sorting mined material is based on using a range of options for sensing multiple properties of a mined material on a fragment by fragment basis and then analyzing the multiple types of data and making decisions about the classification of each fragment and then sorting the fragment based on the analysis. The multiple sensing options include the response of the fragments to electromagnetic radiation. Other sensing options may include sensors that look at the response of fragments of a mined material to an acoustic wave or a magnetic field or optical sensors that evaluate texture or other surface characteristics of fragments.

18 Claims, 2 Drawing Sheets

(56) References Cited

U.S. PATENT DOCUMENTS

Figure 1:
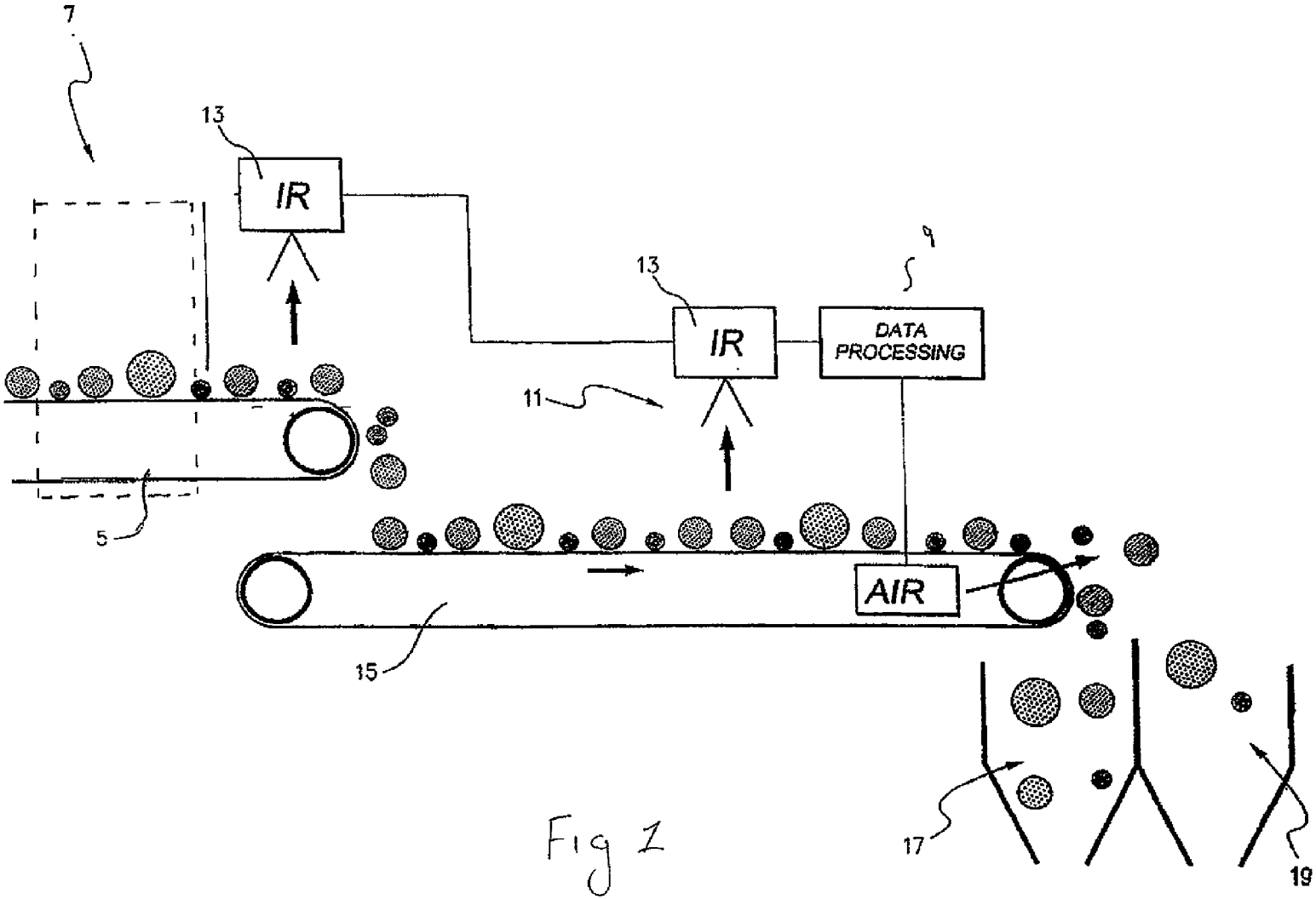

| | | | | |
|---|---|---|---|---|
| 7,659,486 | B2 * | 2/2010 | Valerio | 209/581 |
| 8,436,268 | B1 * | 5/2013 | Afsari et al. | 209/581 |
| 2008/0308471 | A1 * | 12/2008 | Huber et al. | 209/577 |

FOREIGN PATENT DOCUMENTS

| | | | | |
|---|---|---|---|---|
| GB | 2188727 | | 10/1987 | |
| SU | 1118515 | A | 10/1984 | |
| WO | WO 02/31473 | A1 | 4/2002 | |
| WO | WO 2010/028446 | A1 | 3/2010 | |
| WO | WO 2010028446 | A1 * | 3/2010 | B07C 5/342 |

OTHER PUBLICATIONS

International Preliminary Report on Patentability issued by the Australian Patent Office in International Patent Application No. PCT/AU2011/000325, dated Sep. 4, 2012 (5 pages).

EP Application 11 75 8677, Supplementary European Search Report, dated Jan. 17, 2014.

* cited by examiner

SORTING MINED MATERIAL ON THE BASIS OF TWO OR MORE PROPERTIES OF THE MATERIAL

The present invention relates to a method and an apparatus for sorting mined material.

The present invention relates particularly, although by no means exclusively, to a method and an apparatus for sorting mined material for subsequent processing to recover valuable material, such as valuable metals, from the mined material.

The present invention also relates to a method and an apparatus for recovering valuable material, such as valuable metals, from mined material that has been sorted as described above.

The present invention relates to the use of electromagnetic radiation to cause a change in a fragment of a mined material that provides information on properties of the mined material in the fragment that is helpful in terms of classifying the fragment for sorting and/or downstream processing of the fragment and that can be detected by one or more than one sensor. The information may include any one or more of composition, mineralogy, hardness, porosity, structural integrity, and texture.

More generally, the present invention uses a range of options for sensing multiple properties of a mined material on a fragment by fragment basis (as opposed to measurements of bulk material, i.e. multiple fragments together) and then analyses the multiple types of data and makes a decision about the classification of each fragment and then sorts the fragment based on the analysis. As mentioned above, the multiple sensing options include the response of the fragments to electromagnetic radiation. Other sensing options may include sensors that look at the response of fragments of a mined material to an acoustic wave or a magnetic field or optical sensors that evaluate texture or other surface characteristics of fragments, all of which can provide useful information in terms of classifying the fragments for sorting and/or downstream processing of the fragments.

The invention is not confined to any particular type of electromagnetic radiation. The current focus of the applicant is in the microwave energy band of the electromagnetic radiation spectrum. However, radio frequency radiation and x-ray radiation are two other options in the electromagnetic radiation spectrum.

The mined material may be any mined material that contains valuable material, such as valuable metals. Examples of valuable materials are valuable metals in minerals such as minerals that comprise metal oxides or metal sulphides. Specific examples of valuable materials that contain metal oxides are iron ores and nickel laterite ores. Specific examples of valuable materials that contain metal sulphides are copper-containing ores. Another example of a valuable material is salt.

The term "mined" material is understood herein to include (a) run-of-mine material and (b) run-of-mine material that has been subjected to at least primary crushing or similar size reduction after the material has been mined and prior to being sorted.

A particular, although not exclusive, area of interest to the applicant is mined material in the form of mined ores that include copper-containing minerals such as chalcopyrite, in sulphide forms.

The present invention is particularly, although not exclusively, applicable to sorting low grade mined material.

The term "low" grade is understood herein to mean that the economic value of the valuable material, such as a metal, in the mined material is only marginally greater than the costs to mine and recover and transport the valuable material to a customer.

In any given situation, the concentrations that are regarded as "low" grade will depend on the economic value of the valuable material and the mining and other costs to recover the valuable material from the mined material at a particular point in time. The concentration of the valuable material may be relatively high and still be regarded as "low" grade. This is the case with iron ores.

In the case of valuable material in the form of copper sulphide minerals, currently "low" grade ores are run-of-mine ores containing less than 1.0% by weight, typically less than 0.6 wt. %, copper in the ores. Sorting ores having such low concentrations of copper from barren fragments is a challenging task from a technical viewpoint, particularly in situations where there is a need to sort very large amounts of ore, typically at least 10,000 tonnes per hour, and where the barren fragments represent a smaller proportion of the ore than the ore that contains economically recoverable copper.

The term "barren" fragments when used in the context of copper-containing ores are understood herein to mean fragments with no copper or very small amounts of copper that can not be recovered economically from the fragments.

The term "barren" fragments when used in a more general sense in the context of valuable materials is understood herein to mean fragments with no valuable material or amounts of valuable material that can not be recovered economically from the fragments.

The above description is not to be understood as an admission of the common general knowledge in Australia or elsewhere.

According to the present invention there is provided a method of sorting mined material, such as mined ore, comprising the steps of:

(a) exposing individual fragments of the mined material to electromagnetic radiation, with the selection of exposure parameters, such as the type of radiation and the length of exposure and the energy of the radiation, being based on known information on the mined material and downstream processing options for the mined material;

(b) sensing at least two different properties of each fragment that provide information about the fragment (such as composition, mineralogy, hardness, porosity, and texture) using multiple sensors located within and/or downstream of an exposure chamber for electromagnetic radiation and generating data relating to the sensed properties, (c) processing the data for each fragment and classifying the fragment for sorting and/or downstream processing of the fragment, such as heap leaching and smelting, and (d) sorting the fragment based on the classification assessment.

The term "fragment" is understood herein to mean any suitable size of mined material having regard to materials handling and processing capabilities of the apparatus used to carry out the method and issues associated with detecting sufficient information to make an accurate assessment of the mined material in the fragment.

The electromagnetic radiation used in step (a) may be any suitable radiation. For example, the radiation may be X-ray, microwave and radio frequency radiation.

Step (a) may comprise using pulsed or continuous electromagnetic radiation.

The classification of each fragment in step (c) may be on the basis of grade of a valuable mineral in the fragment. The classification of each fragment in step (c) may be on the basis of another property or properties, such as hardness, texture, mineralogy, structural integrity, and porosity. In general terms, the purpose of the classification is to facilitate sorting of the fragments and/or downstream processing of the fragments. Depending on the particular circumstances of a mine, particular combinations of properties may be more or less helpful in providing useful information for sorting of the fragments and/or downstream processing of the fragments.

In this regard, it is noted that it will not always be the case that downstream processing is required and the sorting step may produce a marketable product.

It is also noted that when downstream processing is required, there may be more than one processing option, and sorting step (d) may comprise sorting fragments into two or more classes, each of which is suitable for a different downstream processing option.

Step (b) may comprise detecting the thermal response of each fragment to exposure to electromagnetic radiation.

Step (c) may comprise processing the data for each fragment using an algorithm that takes into account the detected data and classifying the fragment for sorting and/or downstream processing of the fragment.

Step (c) may comprise thermally analysing the fragment to identify valuable material in the fragments.

Step (b) is not confined to sensing the response of fragments of the mined material to electromagnetic radiation and extends to sensing other properties of the material. For example, step (b) extends to the use of any one or more than one of the following sensors: (i) near-infrared spectroscopy ("NIR") sensors (for composition), (ii) optical sensors (for size and texture), (iii) acoustic wave sensors (for internal structure for leach and grind dimensions), (iv) laser induced spectroscopy ("LIBS") sensors (for composition), and (v) magnetic property sensors (for mineralogy and texture); (vi) x-ray sensors for measurement of non-sulphidic mineral and gangue components, such as iron or shale. Each of these sensors is capable of providing information on the properties of the mined material in the fragments, for example as mentioned in the brackets following the names of the sensors.

The method may comprise a downstream processing step of comminuting the sorted material from step (d) as a pre-treatment step for a downstream option for recovering the valuable mineral from the mined material.

The method may comprise a downstream processing step of blending the sorted material from step (d) as a pre-treatment step for a downstream option for recovering the valuable mineral form the mined material.

The method may comprise using the sensed data for each fragment as feed-forward information for downstream processing options, such as flotation and comminution, and as feed-back information to upstream mining and processing options.

The upstream mining and processing options may include drill and blast operations, the location of mining operations, and crushing operations.

According to the present invention there is also provided an apparatus for sorting mined material, such as mined ore, that comprises:

(a) an electromagnetic radiation treatment station for exposing fragments of the mined material on a fragment by fragment basis to electromagnetic radiation;

(b) a plurality of sensors for detecting the response, such as the thermal response, of each fragment to electromagnetic radiation and for detecting other properties of the fragment; and (c) a processor for analysing the data for each fragment, for example using an algorithm that takes into account the detected data, and classifying the fragment for sorting and/or downstream processing of the fragment, such as heap leaching and smelting; and (d) a sorter for sorting the fragments on the basis of the thermal analysis.

The apparatus may comprise an assembly, such as a conveyor belt or belts, for transporting the fragments of the mined material through the electromagnetic radiation treatment station and to the sorter.

According to the present invention there is also provided a method for recovering valuable material, such as a valuable metal, from mined material, such as mined ore, that comprises sorting mined material according to the method described above and thereafter processing the fragments containing valuable material and recovering valuable material.

The method may comprise sorting fragments into two or more classes, each of which is suitable for a different downstream processing option, and thereafter processing the fragments in the different downstream processing options.

The processing options for the sorted fragments may be any suitable options, such as smelting and leaching options.

By way of example, the method may comprise sorting fragments into three classes, with one class comprising low or no value fragments, a second class comprising fragments containing valuable material that are well-suited for a heap leaching process to recover the valuable material, and a third class comprising fragments containing valuable material that are well-suited for a smelting process to recover the valuable material, and thereafter heap leaching the fragments in the second class and smelting the fragments in the third class.

The downstream heap leaching and smelting operations may be carried out at the mine or the fragments could be transported to other locations for the heap leaching and smelting operations.

Figure 2:
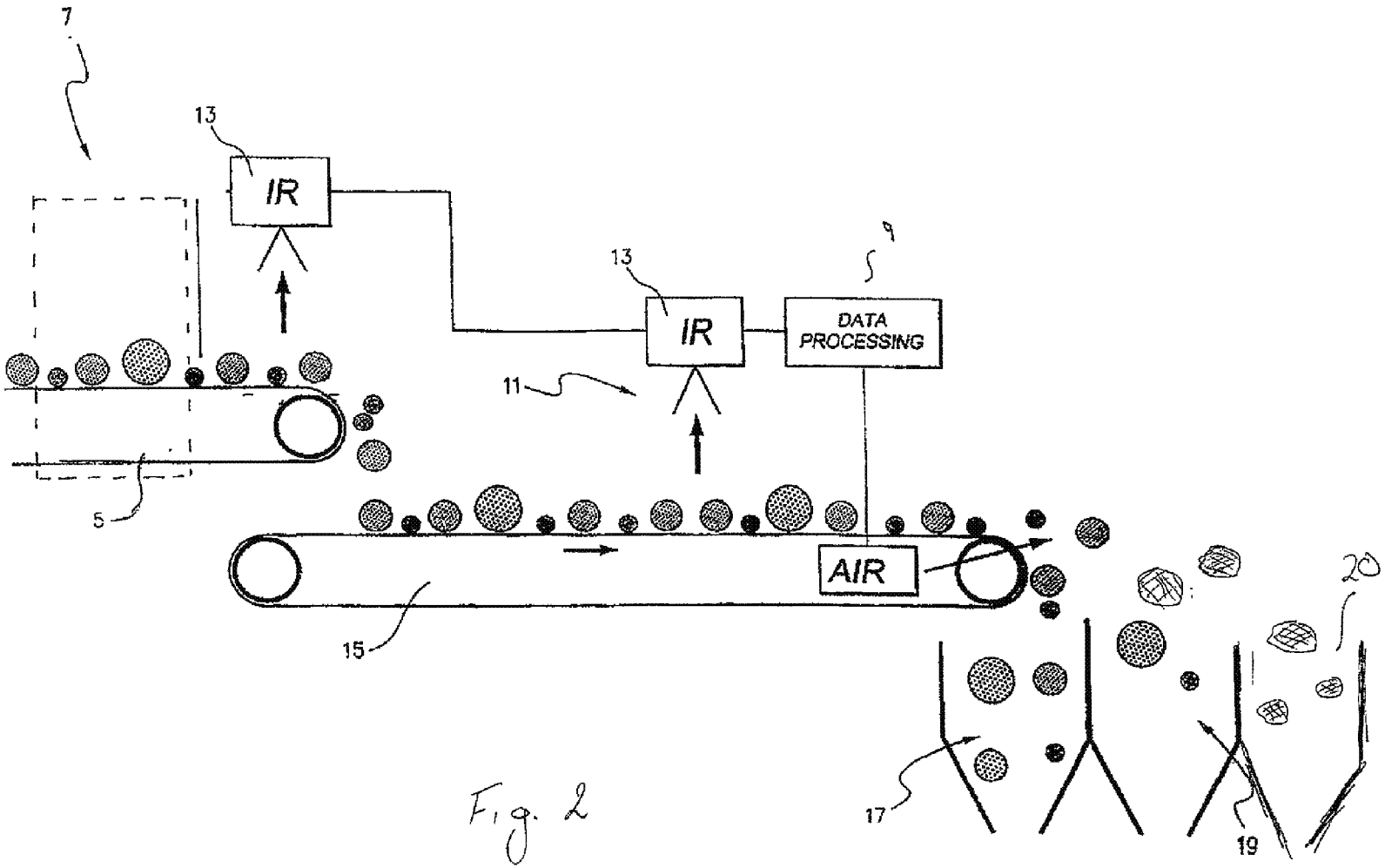

The present invention is described further by way of example with reference to the accompanying drawings in which:

FIG. 1 is a schematic diagram which illustrates one embodiment of a sorting method in accordance with the present invention which has two storing bins provided; and FIG. 2 is a schematic diagram which illustrates a second embodiment of a sorting method in accordance with the present invention which has three sorting bins provided.

The embodiments are described in the context of a method of recovering a valuable metal in the form of copper from low grade copper-containing ores in which the copper is present in copper-containing minerals such as chalcopyrite and the ores also contain non-valuable gangue. The objective of the method in this embodiment is to identify fragments of mined material containing amounts of copper-containing minerals above a certain grade and to sort these fragments from the other fragments and to process the copper-containing fragments using the most effective and viable option to recover copper from the fragments.

It is noted that, whilst the following description does not focus on the downstream processing options, these options are any suitable options ranging from smelting to leaching.

It is also noted that the present invention is not confined to copper-containing ores and to copper as the valuable material to be recovered. In general terms, the present invention provides a method of sorting any minerals which exhibit different heating responses when exposed to electromagnetic radiation.

It is also noted that the present invention is not confined to using a grade threshold as the sole basis for sorting the fragments and the invention extends to considering other properties that are indicators of the suitability of fragments for downstream recovery processes.

It is also noted that the term "fragment" as used herein may be understood by some persons skilled in the art to be better described as "particles". The intention is to use both terms as synonyms.

With reference to the drawing, a feed material in the form of ore fragments 3 that have been crushed by a primary crusher (not shown) to a fragment size of 10-25 cm are supplied via a conveyor belt 5 (or other suitable transfer means) to a microwave radiation treatment station 7 and are moved through an exposure chamber and exposed to microwave radiation, either in the form of continuous or pulsed radiation, on a fragment by fragment basis. The microwave radiation may be applied at a power density below that which is required to induce micro-fractures in the fragments. In any event, the microwave frequency and microwave intensity and the fragment exposure time and the other operating parameters of the microwave treatment station 7 are selected having regard to the information that is required. The required information is information that is helpful in terms of classifying the particular mined material for sorting and/or downstream processing of the fragments. In any given situation, there will be particular combinations of properties, such as grade, mineralogy, hardness, texture, structural integrity, and porosity, that will provide the necessary information to make an informed decision about the sorting and/or downstream processing of the fragments, for example, the sorting criteria to suit a particular downstream processing option.

While passing through microwave treatment station 7 and along a downstream conveyor belt 15, radiation emitted from the fragments is detected by high resolution, high speed infrared imagers 13 which capture thermal images of the fragments. While one thermal imager is sufficient, two or more thermal imagers may be used for full coverage of the fragment surface.

In addition, one or more visible light cameras (not shown) capture visible light images of the fragments to allow determination of fragment size. From the number of detected hot spots (pixels), temperature, pattern of their distribution and their cumulative area, relative to the size of the fragment, an estimation of the grade of observed rock fragments can be made. This estimation may be supported and/or more mineral content may be quantified by comparison of the data with previously established relationships between microwave induced thermal properties of specifically graded and sized rock fragments.

It is noted that there may be a range of other sensors (not shown) positioned within and/or downstream of the microwave exposure chamber depending on the required information to classify the fragments for sorting and/or downstream processing options. These sensors may include any one or more than one of the following sensors: (i) near-infrared spectroscopy ("NIR") sensors (for composition), (ii) optical sensors (for size and texture), (iii) acoustic wave sensors (for internal structure for leach and grind dimensions), (iv) laser induced spectroscopy ("LIBS") sensors (for composition), and (v) magnetic property sensors (for mineralogy and texture); (vi) x-ray sensors for measurement of non-sulphidic mineral and gangue components, such as iron or shale.

Images collected by the thermal imagers and the visible light sensors (and any other sensors) are processed, for example, using a computer 9 equipped with image processing software. The software is designed to process the sensed data to classify the fragments for sorting and/or downstream processing options. In any given situation, the software may be designed to weight different data depending on the relative importance of the properties associated with the data.

In one mode of operation the thermal analysis is based on distinguishing between fragments that are above and below a threshold temperature. The fragments can then be categorised as "hotter" and "colder" fragments. The temperature of a fragment is related to the amount of copper minerals in the fragment. Hence, fragments that have a given size range and are heated under given conditions will have a temperature increase to a temperature above a threshold temperature "x" degrees if the fragments contain at least "y" wt. % copper. The threshold temperature can be selected initially based on economic factors and adjusted as those factors change. Barren fragments will generally not be heated on exposure to radio frequency radiation to temperatures above the threshold temperature.

Once the thermal and visual light analysis is completed by the computer 9 and each fragment is classified, the fragments are separated into one of two (or possibly more) categories.

In the present instance, the primary classification criteria is the grade of the copper in the fragment, with fragments above a threshold grade being separated into one collection bin 19 and fragments below the threshold grade being separated into the other bin 17. The valuable fragments in bin 19 are then processed to recover copper from the fragments. For example, the valuable fragments in the bin 19 are transferred for downstream processing including milling and flotation to form a concentrate and then processing the concentrate to recover copper.

It is noted that the invention makes it possible to have a more sophisticated classification criteria than simply one property, such as the grade of copper in the fragment. The invention makes it possible to take into account a range of properties, such as grade, texture, mineralogy, structural integrity, porosity, and hardness, and to classify the fragments on the basis of suitability for processing the fragments in one or more downstream processing options. For example, there are different combinations of material properties that are optimal for smelting and heap leaching. The invention makes it possible to select fragments based on the available downstream processing operations at a mine or other location. By way of further example, the invention makes it possible to classify fragments on the suitability for blending with fragments from the same or a different mine.

The fragments are separated by being projected from the end of the conveyor belt 15 and being deflected selectively by compressed air jets (or other suitable fluid jets, such as water jets) as the fragments move in a free-fall trajectory from the belt 15 and thereby being sorted into two streams that are collected in the bins 17, 19. The thermal analysis identifies the position of each of the fragments on the conveyor belt 15 and the air jets are activated a pre-set time after a fragment is analysed as a fragment to be deflected.

The fragments in bin 17 may become a by-product waste stream and are disposed of in a suitable manner. This may not always be the case. The fragments have lower concentrations of copper minerals and may be sufficiently valuable for recovery. In that event the colder fragments may be transferred to a suitable recovery process, such as leaching.

Many modifications may be made to the embodiment of the present invention described above without departing from the spirit and scope of the present invention.

The above-described embodiment separates fragments into two bins 17, 19, with bin 19 comprising valuable fragments that are then processed to recover copper from the fragments. The present invention also extends to arrangements in which the sorting step sorts fragments into a category that is essentially a marketable product. For example, in the case of iron ore, the use of magnetic and other sensors may provide sufficient information to sort fragments of magnetite ores from gangue, and the magnetite ore can be sold as a marketable product, without requiring any further processing.

Another, although not the only other possible, embodiment of the invention depicted in FIG. 2 comprises sorting fragments into three classes, with one class comprising low or no value fragments (bin 17), a second class comprising fragments containing valuable material that are well-suited for a first mineral recovery technique, such as a heap leaching process to recover the valuable material (bin 19), and a third class comprising fragments containing valuable material that are well-suited to a second mineral recovery technique, such as a smelting process, to recover the valuable material (bin 20). After sorting into the respective bins, the fragments may be sent to stock piles for subsequent heap leaching, smelting or storage as waste. Two or more jets of compressed air operating at different angles relative to conveyor belt 15 and/or at different pressures and/or different flow rates may be used to effect sorting of material into three bins.

In addition, whilst the embodiment includes exposing the fragments to be sorted to microwave radiation, the present invention is not so limited and extends to the use of any other suitable electromagnetic radiation. Suitable electromagnetic radiation may include X-ray and radio frequency radiation.

The invention claimed is:

1. A method of sorting mined material comprising the steps of:

(a) exposing individual fragments of mined material to electromagnetic radiation, with the selection of exposure parameters being based on known information on the mined material and downstream processing options for the mined material;

(b) sensing at least two different properties of each fragment that provide information about the fragment using multiple sensors located within and/or downstream of an exposure chamber for electromagnetic radiation and generating data relating to the sensed properties, with the sensing step comprising sensing the thermal response of each fragment to exposure to electromagnetic radiation;

(c) processing the data for each fragment and classifying the fragment for sorting and/or downstream processing of the fragment, and (d) sorting the fragment based on the classification assessment.

2. The method defined in claim 1, wherein the electromagnetic radiation includes X-ray, microwave and radio frequency radiation.

3. The method defined in claim 1 or claim 2, wherein step (a) comprises using pulsed or continuous electromagnetic radiation.

4. The method defined in claim 1, wherein the exposure parameters for step (a) include any one or more of the type of radiation, the length of exposure, and the energy of the radiation.

5. The method defined in claim 1, wherein step (c) comprises analysing the thermal response of each fragment to exposure to electromagnetic radiation to identify valuable material in the fragment.

6. The method defined in claim 1, wherein step (b) comprises sensing the response of fragments to exposure to electromagnetic radiation and sensing other properties of fragments, with the other properties including any one or more of grade, hardness, texture, mineralogy, structural integrity, and porosity.

7. The method defined in claim 6, wherein step (b) includes the use of any one or more than one of the following sensors to sense properties of fragments: (i) non-infrared spectroscopy ("NIR") sensors, (ii) optical sensors, (iii) acoustic wave sensors, (iv) laser induced spectroscopy ("LIBS") sensors, and (v) magnetic property sensors.

8. The method defined in claim 1, wherein step (c) comprises processing the data for each fragment using an algorithm that takes into account the detected data and classifying the fragment for sorting and/or downstream processing of the fragment.

9. The method defined in claim 1, comprising a downstream processing step of comminuting the sorted material from step (d) as a pre-treatment step for a downstream option for recovering the valuable mineral from the mined material.

10. The method defined in claim 1, comprising a downstream processing step of blending the sorted material from step (d) as a pre-treatment step for a downstream option for recovering the valuable mineral form the mined material.

11. The method defined in claim 1, comprising using the sensed data for each fragment as feed-forward information for downstream processing options, and as feed-back information to upstream mining and processing options.

12. An apparatus for sorting mined material that comprises:

(a) an electromagnetic radiation treatment station for exposing fragments of mined material on a fragment by fragment basis to electromagnetic radiation;

(b) a plurality of sensors for detecting the response of each fragment to electromagnetic radiation and for detecting other properties of the fragments, with at least one sensor being adapted to detect the thermal response of fragments; wherein the sensors detect at least two different properties of each fragment; and (c) a processor for analysing the data for each fragment and classifying the fragment for sorting and/or downstream processing of the fragment; and (d) a sorter for sorting the fragments on the basis of the thermal analysis.

13. The apparatus defined in claim 12, wherein the processor is adapted to analyse the data for each fragment using an algorithm that takes into account the detected data.

14. The apparatus defined in claim 12, comprises an assembly for transporting the fragments of the mined material through the electromagnetic radiation treatment station and to the sorter.

15. A method for recovering valuable material from mined material that comprises sorting mined material according to the method defined in claim 1, and thereafter processing the fragments containing valuable material and recovering valuable material.

16. The method defined in claim 15, comprises sorting fragments into two or more classes, each of which is suitable for a different downstream processing option, and thereafter processing the fragments in the different downstream processing options.

17. The method defined in claim 15 or claim 16, wherein the processing options for the sorted fragments include smelting and leaching process options.

18. The method defined in claim 15, comprises sorting fragments into three classes, with one class comprising low or no value fragments, a second class comprising fragments containing valuable material that are well-suited for a heap leaching process to recover the valuable material, and a third class comprising fragments containing valuable material that are well-suited for a smelting process to recover the valuable material, and thereafter heap leaching the fragments in the second class and smelting the fragments in the third class.

* * * * *